US010716327B2

(12) United States Patent
Tiefenbacher, Jr.

(10) Patent No.: US 10,716,327 B2
(45) Date of Patent: Jul. 21, 2020

(54) PORTABLE CLEANER WITH INTEGRATED FLUID STORAGE COMPARTMENT AND METHOD OF USING THE SAME

(71) Applicant: Robert Thomas Tiefenbacher, Jr., Ipswich, MA (US)

(72) Inventor: Robert Thomas Tiefenbacher, Jr., Ipswich, MA (US)

( * ) Notice: Subject to any disclaimer, the term of this patent is extended or adjusted under 35 U.S.C. 154(b) by 2 days.

(21) Appl. No.: 15/970,246

(22) Filed: May 3, 2018

(65) Prior Publication Data

US 2018/0317547 A1 Nov. 8, 2018

Related U.S. Application Data

(60) Provisional application No. 62/500,811, filed on May 3, 2017.

(51) Int. Cl.

| | |
|---|---|
| ***A24F 9/12*** | (2006.01) |
| ***A24F 9/06*** | (2006.01) |
| ***A24F 9/08*** | (2006.01) |
| ***A24F 9/10*** | (2006.01) |

(52) U.S. Cl.

CPC ..... *A24F 9/12* (2013.01); *A24F 9/06* (2013.01); *A24F 9/08* (2013.01); *A24F 9/10* (2013.01)

(58) Field of Classification Search

CPC ..... A24F 9/04; A24F 9/06; A24F 9/08; A24F 9/10; A24F 9/12

USPC ..... 15/104.05; 131/243, 245, 246; 401/121, 401/122, 127, 128, 268

See application file for complete search history.

(56) References Cited

U.S. PATENT DOCUMENTS

| | | | | | |
|---|---|---|---|---|---|
| 75,449 | A * | 3/1868 | Naylor | B08B 9/0436 | 15/104.05 |
| 798,229 | A * | 8/1905 | Taylor | A24F 9/02 | 131/243 |
| 902,803 | A * | 11/1908 | Clearwater | A24F 9/06 | 131/245 |
| 961,215 | A * | 6/1910 | Cunningham | A24F 9/06 | 131/245 |
| 986,268 | A * | 3/1911 | Colina et al. | E03F 9/005 | 15/104.33 |
| 1,081,038 | A * | 12/1913 | Haig | A24F 9/06 | 131/245 |
| 1,347,304 | A * | 7/1920 | Tallman | A24F 9/06 | 131/245 |
| 1,370,271 | A * | 3/1921 | Benedict | A24F 9/06 | 131/245 |
| 1,477,207 | A * | 12/1923 | Brown | A24F 9/06 | 131/245 |
| 1,526,938 | A * | 2/1925 | Sommerfeldt | A24F 9/08 | 131/243 |

(Continued)

*Primary Examiner* — Patrick M. Buechner

(74) *Attorney, Agent, or Firm* — Law Office of Jerry Joseph, PLC; Jerry Joseph

(57) ABSTRACT

A portable cleaner apparatus including a housing member having a compartment configured to store a solvent, a handle portion coupled to a brush member via a flexible member having a guide member, and an absorbent material disposed within the housing member and configured to transfer the solvent to the brush member. The guide member may be configured to include a rounded leading edge to help guide the cleaning brush within narrow and curved pathways within medical devices, tubing, smoking pipes, or other devices, without causing damage.

10 Claims, 9 Drawing Sheets

(56) References Cited

U.S. PATENT DOCUMENTS 1,558,652 A * 10/1925 Thornton ..... A24F 9/08 131/243
1,644,574 A * 10/1927 Hamilton ..... A24F 9/06 131/245
1,688,874 A * 10/1928 Morgan ..... A24F 9/10 131/245
1,689,226 A * 10/1928 Brown ..... A24F 9/08 131/243
D106,307 S * 10/1937 Leuser ..... D27/196
2,189,556 A * 2/1940 Younghusband ..... A24F 9/06 206/209
D125,131 S * 2/1941 Giesen ..... D27/196
2,304,281 A * 12/1942 Riley ..... A24F 9/06 131/245
D150,196 S * 7/1948 Bauer ..... D27/143
2,517,740 A * 8/1950 Uldbjerg ..... A24F 9/06 131/245
2,774,093 A * 12/1956 King ..... A47K 17/00 401/122
2,790,448 A * 4/1957 Bock ..... A24F 9/04 131/243
3,115,270 A * 12/1963 Melnikoff ..... A45D 40/267 220/780
3,146,806 A * 9/1964 Ginsburg ..... A45D 34/04 141/110
3,416,539 A * 12/1968 Sharpe ..... A24F 9/06 131/245
3,672,374 A * 6/1972 Mancuso ..... A24F 9/04 131/243
3,853,132 A * 12/1974 Patton ..... A24F 9/02 131/243
4,188,959 A * 2/1980 Karalius ..... A24F 9/04 131/245
4,440,181 A * 4/1984 Scherer ..... A45D 29/007 132/73.5
6,699,331 B1 * 3/2004 Kritzler ..... A61B 17/221 134/22.11
7,225,814 B2 * 6/2007 Barclay ..... A45D 29/007 132/74.5
7,685,668 B2 * 3/2010 Tourigny ..... B08B 1/00 15/104.001
2004/0161285 A1 * 8/2004 Gueret ..... A45D 34/04 401/130
2015/0164135 A1 * 6/2015 Boring ..... A24F 9/06 131/243

* cited by examiner 100
110
110a
120
118
129
130

110
110a
112
129
130

110
110a
112
118
120
129
130

110
110a
118

PORTABLE CLEANER WITH INTEGRATED FLUID STORAGE COMPARTMENT AND METHOD OF USING THE SAME

BACKGROUND OF THE INVENTION

1. Field of the Invention

The present general inventive concept generally relates to a portable cleaner, and more particularly, to a disposable cleaner having an integrated cleaning fluid storage compartment and a flexible brush configured to clean various objects, including airways of a smoking pipe.

2. Background of the Invention

Smoking pipes have been used to smoke tobacco and other substances for many generations. However, over time, tar, resin, and tobacco residue builds up within the airways of the smoking pipe, thereby blocking the airways and making the pipe unusable. As a result, many users are then required to perform complicated and time-consuming cleaning processes to unblock or unclog the airways within the smoking pipe to insure a clean and flavorful draw. However, in order to be able to use their smoking pipes at all times, some users are burdened with carrying conventional pipe brushes and bulky cleaning solution containers where ever they go.

However, in addition, these cleaning processes often require the user to have access to certain non-portable tools and supplies. For example, some cleaning protocols require boiling water and volatile cleaning solutions to properly clean the smoking pipes. This prevents many users from being able to clean their smoking pipes, while away from such tools and supplies. Although, some pipe cleaning devices are available on the market today; they are not easily transported or equipped with a self-contained liquid cleaning solution. Additionally, caps of these devices are configured to screw-on to a brush via threading, making removal of the brush from the cap more difficult than necessary. This is especially true if any resin contaminates the threading.

Therefore, what is desired is a disposable cleaning device that is portable and includes all of the necessary tools and solutions to properly clean various objects, including smoking pipes.

BRIEF SUMMARY OF THE INVENTION

The present general inventive concept generally relates to a portable smoking pipe cleaner that is used to clean smoking pipes, and more particularly, to a portable and disposable pipe cleaner that has an integrated cleaning solution storage compartment that is used with the pipe cleaner to clean airways of the smoking pipe. In exemplary embodiments, the portable smoking pipe cleaner includes a pipe cleaner portion having a handle and a cleaning solution storage compartment which is used to enclose the pipe cleaner portion and a cleaning solution used to clean smoking pipes. In exemplary embodiments, the integrated cleaning solution storage compartment is sealed off from the external environment to prevent the cleaning solution from evaporating and is unsealed when the pipe cleaner portion is removed for use. As such, a user may use the portable smoking pipe cleaner according to the present general inventive concept to clean his smoking pipe, even when away from certain non-portable cleaning tools and supplies.

In exemplary embodiments, the integrated cleaning solution storage compartment is sealed off from the external environment and unsealed when the portable pipe cleaner is removed and ready to be used to clean a smoking pipe. The portable pipe cleaner may be referred to as "pipe buddy" for marketing and sales purposes. However, the present general inventive concept is not limited thereto.

Features and/or utilities of the present general inventive concept may be achieved by providing a portable cleaner apparatus which includes a housing member having a compartment configured to store a solvent, a handle portion coupled to a brush member via a flexible member having a guide member, and an absorbent material disposed within the housing member and configured to transfer the solvent to the brush member.

The housing member may further include a scraping member configured to scrape debris.

The handle portion may include a guide member coupled to an end thereof and configured to help protect surfaces from damage and guide the brush member within pathways of a device to be cleaned.

The absorbent material may include a hole configured to clean the brush member.

The brush member may be disposed within the hole when the handle portion is assembled onto the housing member handle portion.

The brush member may be formed from a twisted core material having bristles protruding therefrom.

Features and/or utilities of the present general inventive concept may be achieved by providing a method of using a portable cleaner apparatus, the method includes obtaining a portable cleaner apparatus, the apparatus comprising a housing member having a compartment configured to store a solvent, a handle portion coupled to a brush member via a flexible member having a guide member, and an absorbent material disposed within the housing member and configured to transfer the solvent to the brush member, removing the handle portion from the housing member, allowing the flexible member to bend to correspond to a path to be cleaned, and cleaning the path using the brush member.

The handle portion may further include a scraping member configured to scrape debris.

The absorbent material may include a hole configured to clean the brush member.

The brush member may be disposed within the hole when the handle portion is assembled onto the housing member handle portion.

The brush member may be formed from a twisted core material having bristles protruding therefrom.

Additional aspects of the present general inventive concept will be set forth in part in the description which follows and, in part, will be obvious from the description, or may be learned by practice of the general inventive concept.

BRIEF DESCRIPTIONS OF THE DRAWINGS

These and/or other aspects of the present general inventive concept will become apparent and more readily appreciated from the following description of the embodiments, taken in conjunction with the accompanying drawings of which:

DETAILED DESCRIPTION OF PREFERRED EMBODIMENTS

In exemplary embodiments, the portable cleaner apparatus includes a housing member having an integrated cleaning solution storage compartment and a removable handle portion that is coupled to a brush member via a flexible member. In alternative embodiments, the removable handle portion further includes a guide member disposed at a distal end of the brush member and configured to guide the brush member through various pathways, without scratching or otherwise damaging the pathways.

In alternative embodiments, the portable cleaner apparatus includes a pipe cleaner portion having a handle and a cleaning solution storage compartment which is used to enclose the pipe cleaner portion and a cleaning solution used to clean smoking pipes. In exemplary embodiments, the integrated cleaning solution storage compartment is sealed off from the external environment to prevent the cleaning solution from evaporating and is unsealed when the pipe cleaner portion is removed for use.

In exemplary embodiments, the integrated cleaning solution storage compartment is sealed off from the external environment and unsealed when the cleaning brush is removed from the housing member and ready to be used to clean pathways of various devices, including medical devices, tubing, breathing devices, smoking pipes and various other devices having narrow pathways. However, the present general inventive concept is not limited thereto.

The present general inventive concept provides a portable cleaner which is disposable that includes a flexible cleaning brush stored within a housing that may be used to store a cleaning solution to disinfect and/or clean a wide variety of medical devices, tubing, as well as smoking pipes. The embodiments illustrating the present invention in use with conventional smoking pipes are for illustrative purposes only and shall not limit the scope or intended uses of the portable cleaner apparatus according to the present general inventive concept.

Figure 1A:
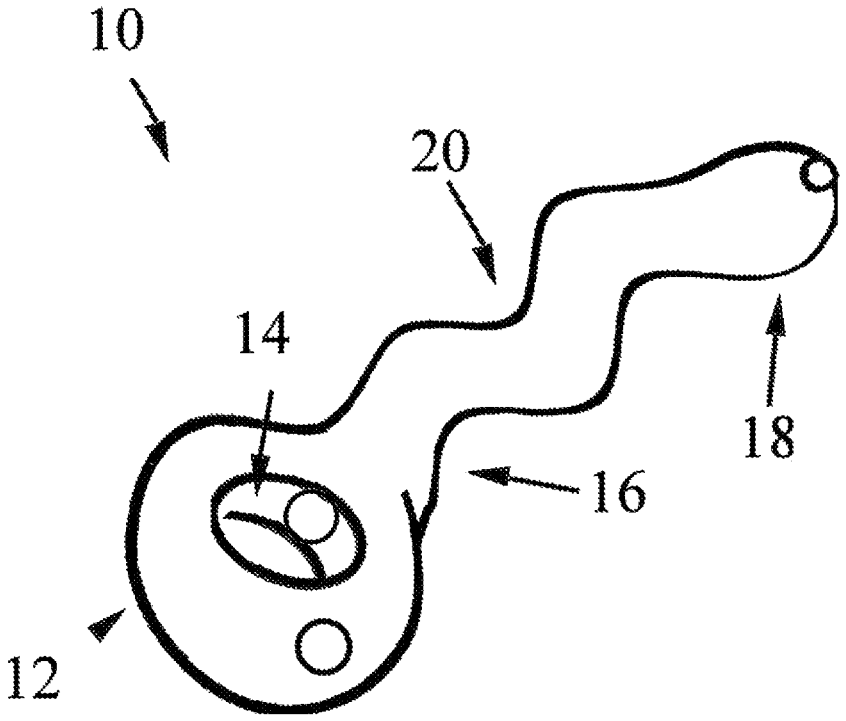
FIG. 1A illustrates a schematic cross-sectional view of a conventional smoking pipe.

FIG. 1A illustrates a schematic cross-sectional view of a conventional smoking pipe 10.

Referring to FIG. 1A, conventional smoking pipes 10 include a bowl 12 having a chamber 14 which is used to store and burn a smoking medium such as tobacco, a shank portion 16, a stem 18, and an internal pathway 20 extending from the stem 18 to the chamber 14. However, after use, the internal pathway 20 within the smoking pipe 10 often becomes clogged with resin, tobacco, and/or other debris.

As a result, this pathway 20 must be cleaned on occasion in order to continue using the smoking pipe 10. The pathway 20 includes narrow and/or curved air passages which are difficult to clean properly without specific tools and cleaning solutions, such as a brush and alcohol-based solvents. However, these tools and solutions are bulky and are cumbersome to easily transport with a user when on the go. In addition, conventional cleaning tools may damage or scratch narrow pathways due to sharp edges and corners.

Figure 2A:
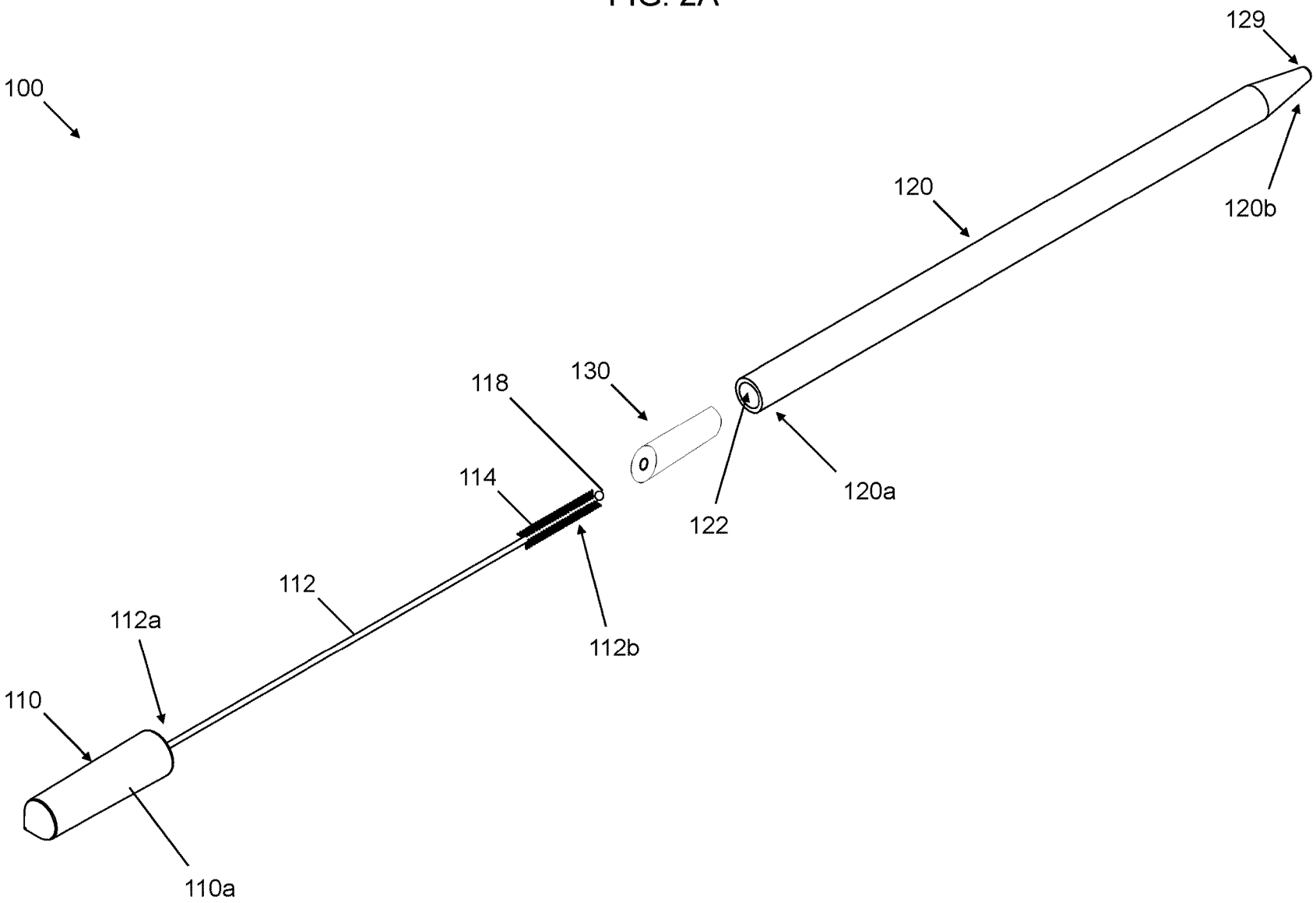
FIG. 2A illustrates a front perspective exploded assembly view of a portable cleaner apparatus according to an exemplary embodiment of the present general inventive concept.
Figure 2B:
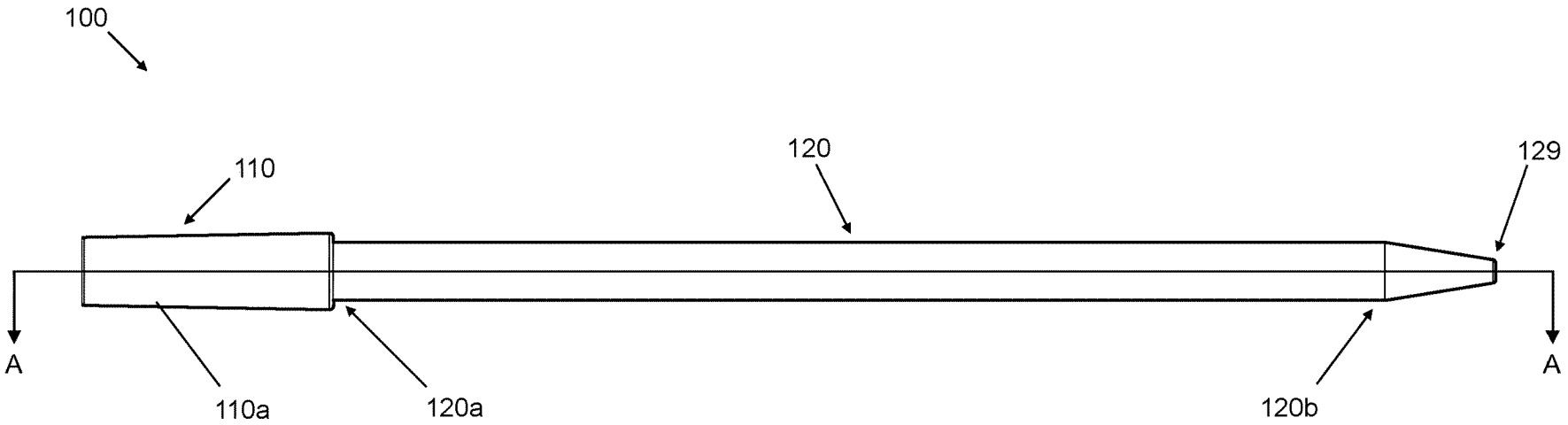
FIG. 2B illustrates a front view of the portable cleaner apparatus shown in FIG. 2A, in an assembled state.
Figure 2D:
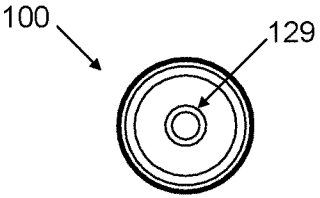
FIG. 2D illustrates a right-side view of the portable cleaner apparatus shown in FIG. 2B.
Figure 2C:
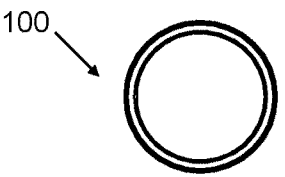
FIG. 2C illustrates a left side view of the portable cleaner apparatus shown in FIG. 2B.
Figure 2E:
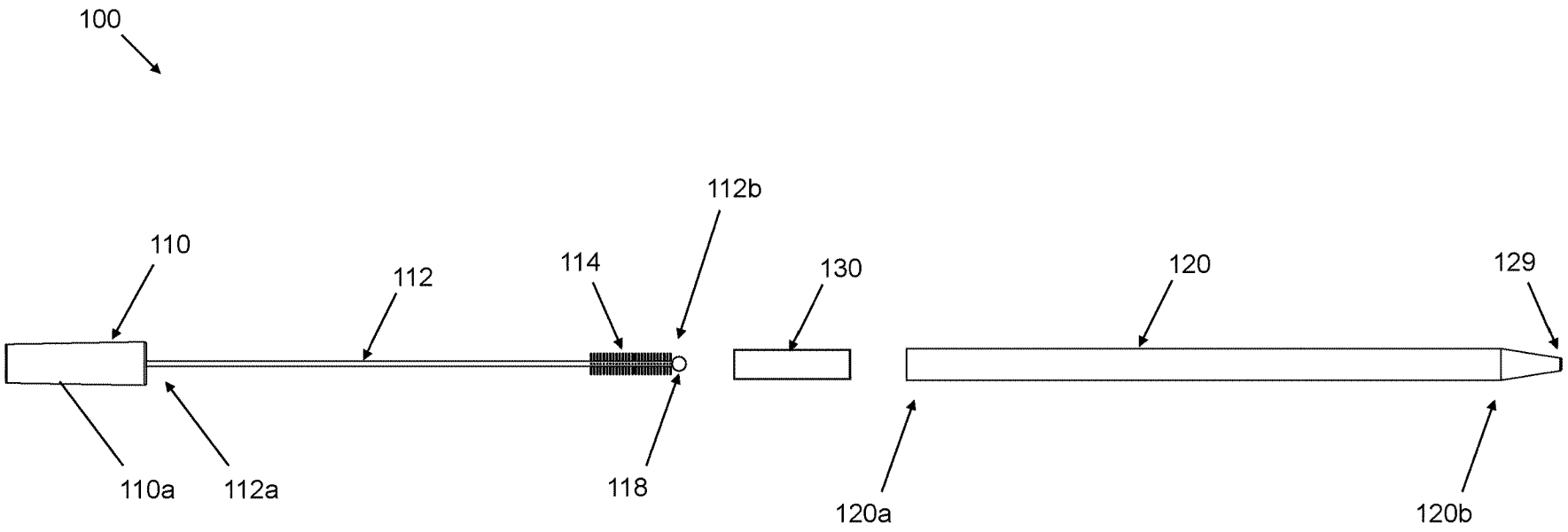
FIG. 2E illustrates a front view of the portable cleaner apparatus shown in FIG. 2B, in an unassembled state.

FIG. 2A illustrates a front perspective exploded assembly view of a portable cleaner apparatus 100 according to an exemplary embodiment of the present general inventive concept. FIG. 2B illustrates a front view of the portable cleaner apparatus 100 shown in FIG. 2A, in an assembled state. FIG. 2C illustrates a left side view of the portable cleaner apparatus 100 shown in FIG. 2B. FIG. 2D illustrates a right-side view of the portable cleaner apparatus 100 shown in FIG. 2B and FIG. 2E illustrates a front view of the portable cleaner apparatus 100 shown in FIG. 2B, in an unassembled state.

Referring to FIGS. 2A to 2E, an exemplary embodiment of the portable cleaning device 100 includes all of the necessary tools and cleaning solutions to clean and/or disinfect internal and/or external surfaces of medical devices, tubing, smoking pipes 10, and/or other devices. However, the present general inventive concept is not limited thereto. That is, in the present embodiment, the portable cleaning device 100 includes a handle portion 110 coupled to a flexible member 112 and a cleaning brush 114, a housing member 120 having an integrated fluid storage compartment 122, and an absorbent material 130 (e.g., a cylindrical shaped sponge having a through hole) disposed within the storage compartment 122 of the housing member 120.

The flexible member 112 includes a first end **112*a* and an opposing second end 112*b*. The handle portion 110 includes a handle member 110*a* coupled to the first end 112*a* of the flexible member 112 and a cleaning brush 114 coupled to the second end 112*b* of the flexible member 112**.

The housing member 120 includes an integrated fluid storage compartment 122 formed between a first end **120*a* and a second end 120*b* of the housing member 120 and is configured to store a fluid, disinfectant, solvent, or various other types of solutions, including alcohol and non-alcohol-based cleaning solutions. However, the present general inventive concept is not limited thereto. That is, in alternative embodiments, the fluid storage compartment 122** may be configured to store various items, including sponges, additional brushes, and sealed pouches of cleaning solutions.

In exemplary embodiments, the flexible member 112 is constructed from twisted core metal or various other flexible materials which allows the cleaning brush 114 to flex, bend, and conform to various curved pathways within medical devices, tubing, smoking pipes 10, and/or other devices.

In the present embodiment, the handle portion 110 further includes a guide member 118 that is coupled to the second end **112*b* of the flexible member 112 after the cleaning brush 114 in order to prevent or substantially reduce damage caused when cleaning curved pathways within medical devices, tubing, smoking pipes 10**, and/or other devices when being used.

In exemplary embodiments, the guide member 118 may be formed in a rounded shape and is configured to guide the flexible member 112 and the cleaning brush 114 to bend and/or conform to various curved pathways within medical devices, tubing, smoking pipes 10, or other devices. However, the present general inventive concept is not limited thereto. That is, in alternative embodiments, the guide member 118 may be formed in various shapes and materials to prevent damage.

In the present embodiment, the guide member 118 may initially contact surfaces of the pathways intended to be cleaned and/or disinfected and directs a force onto the flexible member 112 to thereby flex and/or bend in order to follow a profile of the pathway to be cleaned, without damaging the surface. That is, the guide member 118 may be configured to include a rounded leading edge to help guide the cleaning brush 114 within narrow and curved pathways within medical devices, tubing, smoking pipes 10, or other devices.

In exemplary embodiments, the guide member 118 may be constructed from various materials including nylon or other plastics designed to prevent scratching or damaging of pathways within medical devices, tubing, smoking pipes 10, or other devices. However, the present general inventive concept is not limited thereto.

In the present embodiment, the handle portion 110 is detachably coupled to a housing member 120 which includes an integrated fluid storage compartment 122 that may be used to store a cleaning solution and/or disinfectant. That is, the handle member 110*a* of handle portion 110 is detachably coupled to the first end 120*a* of the housing member 120 in order to seal off the storage compartment 122 formed within the housing member 120 from an external environment. The handle member 110*a* is detachably coupled to the housing member 120 without the use of any threads, thereby reducing manufacturing costs and simplifying the assembly process. In exemplary embodiments, the handle portion 110 is detachably coupled to the housing member 120 using a press-fit type fastening means. In alternative embodiments, the housing member 120 may further include a sealing member such as an O-ring disposed near the first end 120*a* to further seal the storage compartment 122 from the external environment.

In alternative exemplary embodiments, the handle portion 110 is configured to position the cleaning brush 114 within the cleaning and/or disinfectant solutions stored within the integrated storage compartment 122 of the housing member 120 when assembled onto the housing member 120. That is, when assembled, the cleaning brush 114 may remain in contact with the cleaning solution or disinfectant disposed within the housing member 120 and is coated with the cleaning solution when removed in order to apply the cleaning solution within the narrow and curved pathways within medical devices, tubing, smoking pipes 10, or other devices.

In exemplary embodiments, the portable cleaner apparatus 100 may further include an absorbent material 130 disposed within the storage compartment 122 of the housing member 120 to contain the cleaning and/or disinfectant solution stored within the housing member 120.

As such, the portable cleaning device 100 according to the present general inventive concept provides a user with ready access to an integrated cleaning brush 114 and cleaning solution stored within a housing member 120 in a single disposable device which is configured to clean and disinfect a wide variety of devices having narrow pathways.

Figure 3A:
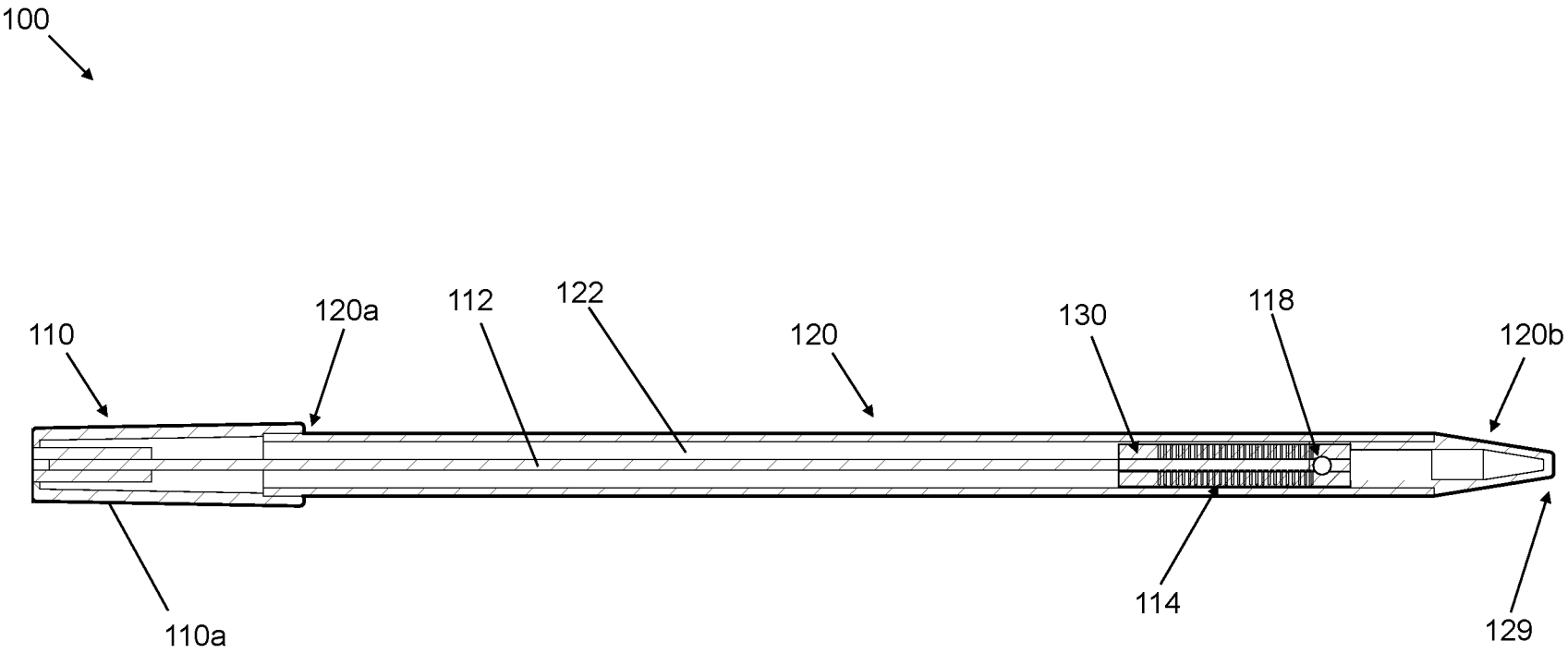
FIG. 3A illustrates a cross-sectional front view of the portable cleaner apparatus shown in FIG. 2B, along line A-A.
Figure 3B:
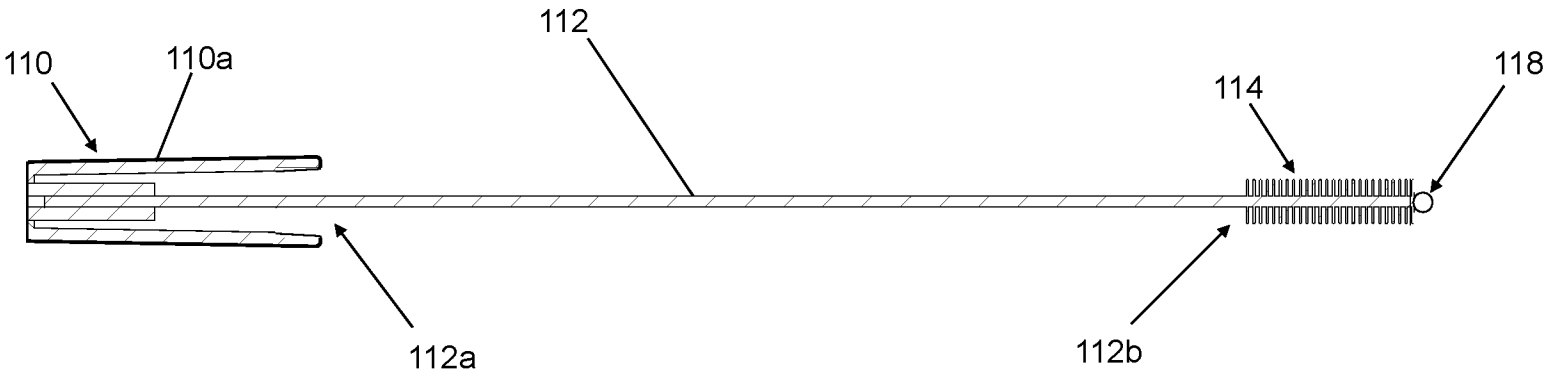
FIG. 3B illustrates a cross-sectional front view of the handle portion shown in FIG. 2E.
Figure 3C:
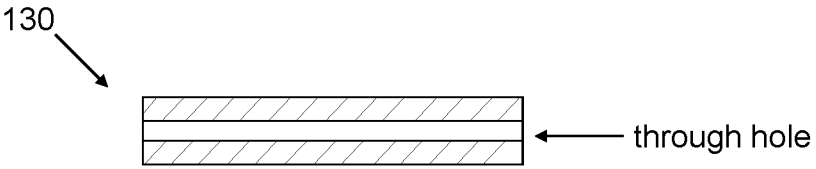
FIG. 3C illustrates a cross-sectional front view of the absorbent material shown in FIG. 2E.
Figure 3D:
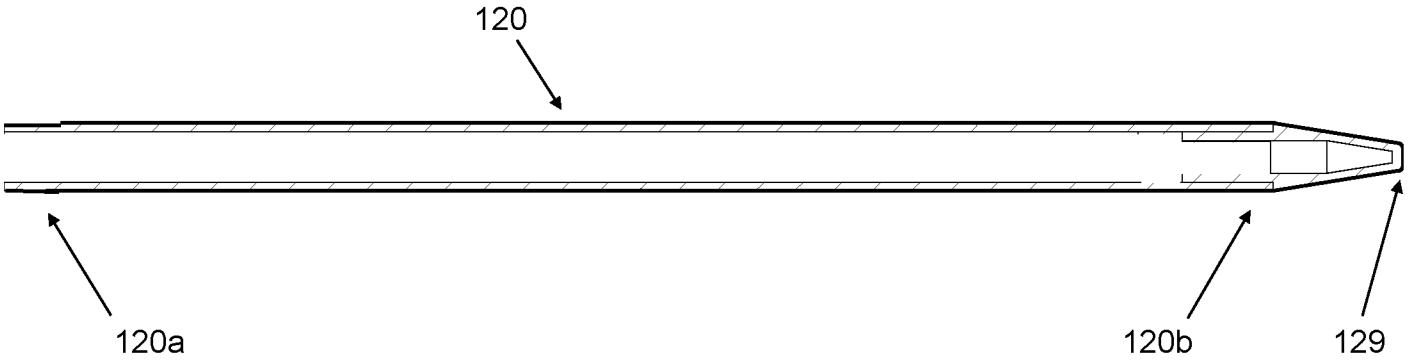
FIG. 3D illustrates a cross-sectional front view of the housing member shown in FIG. 2E.

FIG. 3A illustrates a cross-sectional front view of the portable cleaner apparatus shown in FIG. 2B, along line A-A. FIG. 3B illustrates a cross-sectional front view of the handle portion shown in FIG. 2E. FIG. 3C illustrates a cross-sectional front view of the absorbent material shown in FIG. 2E. FIG. 3D illustrates a cross-sectional front view of the housing member shown in FIG. 2E.

Referring to FIGS. 3A through 3D, the housing member 120 may be formed in a hollow or substantially hollow cylindrical tube. The housing member 120 may have a length of about 1 inch to about 12 inches. As such, the housing member 120 includes an integrated fluid storage compartment 122 formed between the first end 120*a* and the second end 120*b* of the housing member 120. However, the present general inventive concept is not limited thereto. That is, in alternative embodiments, the housing member 120 may be formed in various shapes and sizes, as desired.

Referring to FIGS. 3A through 3D, in an exemplary embodiment, the portable cleaner apparatus 100 may further include a flattened edge shaped scraping member 129 disposed on the housing member 120 to assist in removing debris from devices.

In alternative embodiments, the storage compartment 122 may be configured to store various items, including sponges, additional brushes, and sealed pouches of cleaning solutions.

In the present exemplary embodiment, the housing member 120 further includes a scraping member 129 configured to scrape resin, residue or other debris from within the pathways 20 of the smoking pipe 10 or from various other items. The scraping member 129 may be formed in various shapes including a point, a flattened edge shape, a hook shape, and a pick shape. However, the present general inventive concept is not limited thereto.

Figures 4A, 4B, 4C, 4D:
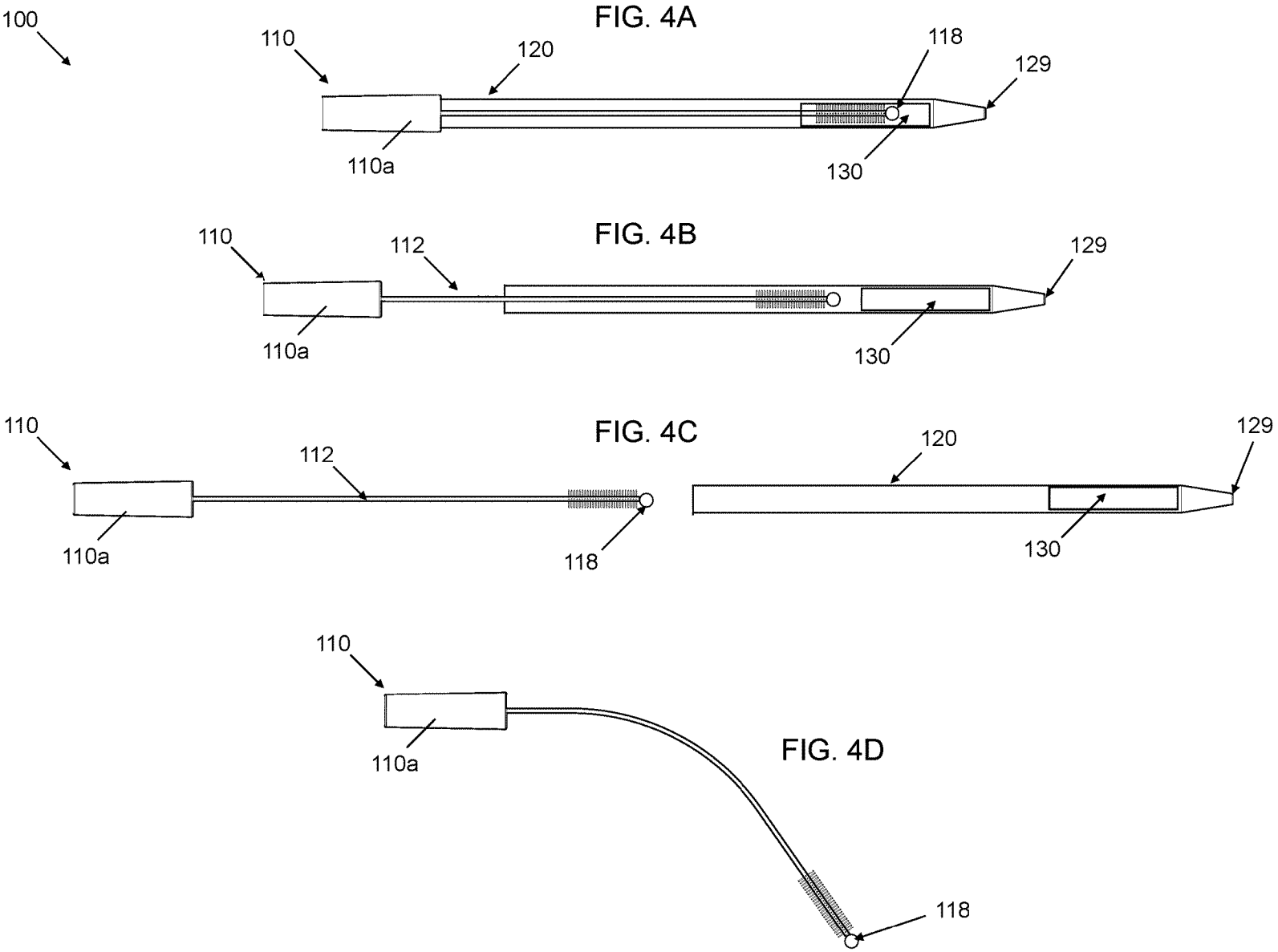
FIGS. 4A through 4E illustrates a method of using a portable cleaner apparatus according to an exemplary embodiment of the present general inventive concept.
Figure 4E:
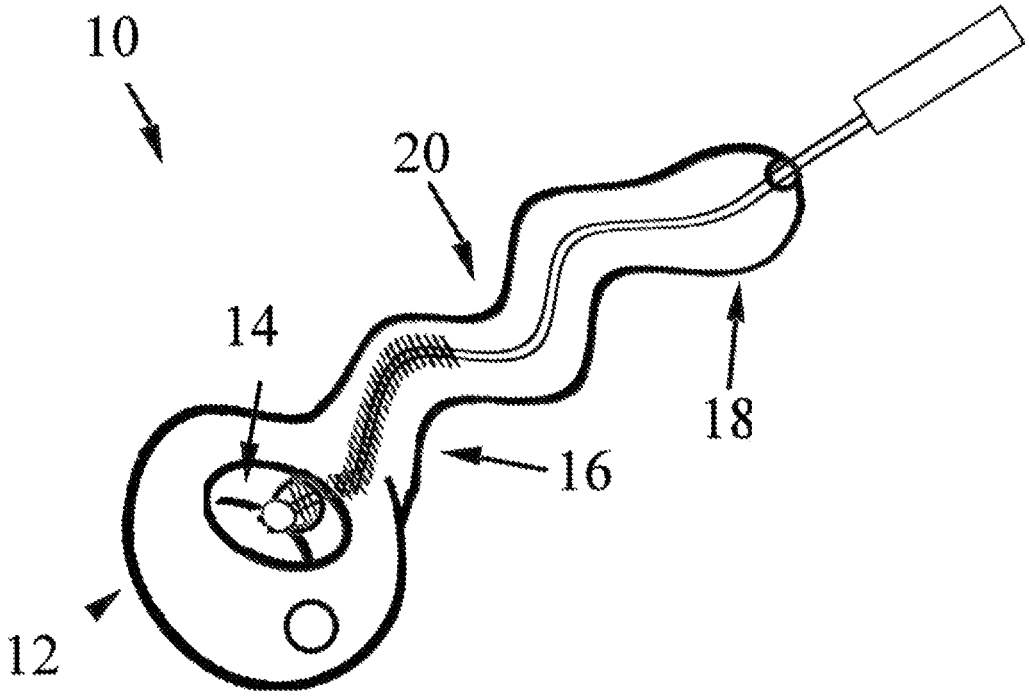

FIGS. 4A through 4E illustrates a method of using a portable cleaner apparatus according to an exemplary embodiment of the present general inventive concept. FIG. 4A illustrates a schematic front view of the portable cleaner apparatus 100 in a completely assembled state. FIG. 4B illustrates the portable cleaner apparatus 100 shown in FIG. 4A, wherein the handle portion is partially removed. FIG. 4C illustrates the portable cleaner apparatus 100 shown in FIG. 4A, wherein the handle portion is completely removed and FIG. 4D illustrates the handle portion shown in FIG. 4C, wherein the flexible member is bent to allow the brush member to conform to various pathways. FIG. 4E illustrates an exemplary method of using the portable cleaner apparatus 100 on a conventional smoking pipe.

In the present embodiment, a user may first pull the handle member 110*a* in order to remove the handle portion 110 from the housing member 120 and thereby provide access to the brush member 114 coated with a cleaning solution disposed within the storage compartment 122 used to clean and/or disinfect internal and/or external surfaces of medical devices, tubing, smoking pipes 10, and/or other devices.

The user may further use the scraping member 129 to scrape and remove any residue or other debris remaining within the smoking pipe 10 or other device.

In exemplary embodiments, the flexible member 112 is configured to bend into various shapes and orientations in order to conform to and fit into various pathways 20 within the conventional smoking pipe 10 or various other items. However, the present general inventive concept is not limited thereto.

In alternative exemplary embodiments, the portable cleaner apparatus 100 further includes an absorbent material 130, such as a sponge or foam, disposed within the housing member 120 and configured to transfer the fluid, solvent, or cleaning solution stored within the storage compartment 122 to the brush member 114.

The method of using the portable cleaner apparatus of using a portable cleaner apparatus 100 according to the present exemplary embodiment includes pulling out the brush member 114 from within the housing member 120 without needing to unscrew the handle member 110*a* and then inserting the guide member 118 into a desired pathway to be cleaned or disinfected. The flexible member 112 and the brush member 114 will conform to the various pathways to be cleaned and guided by the guide member 118 without causing damage to the pathways. The guide member 118 includes a rounded leading edge 118 which helps protect surfaces to be cleaned from damage as well as guide the flexible member 112 to conform to various profiles of different narrow pathways.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A portable cleaner apparatus comprising:

a housing member having a compartment configured to store a solvent;

a handle portion coupled to a brush member via a flexible member;

a guide member having a spherical shape coupled to an end of the flexible member, and an absorbent material disposed within the housing member and configured to transfer the solvent to the brush member, wherein the guide member is configured to bed the flexible member to conform to curved pathways.

2. The portable cleaner apparatus of claim 1, wherein the housing member further includes a scraping member configured to scrape debris.

3. The portable cleaner apparatus of claim 1, wherein the brush member is formed from a twisted core material having bristles protruding therefrom.

4. The portable cleaner apparatus of claim 1, wherein the absorbent material includes a hole configured to clean the brush member.

5. The portable cleaner apparatus of claim 4, wherein the brush member is disposed within the hole when the handle portion is assembled onto the housing member.

6. A method of using a portable cleaner apparatus, the method comprising:

obtaining a portable cleaner apparatus, the apparatus comprising a housing member having a compartment configured to store a solvent, a handle portion coupled to a brush member via a flexible member, a guide member having a spherical shape coupled to an end of the flexible member; and an absorbent material disposed within the housing member and configured to transfer the solvent to the brush member, wherein the guide member is configured to bend the flexible member to conform to curved pathways;

removing the handle portion from the housing member;

allowing the flexible member to bend to correspond to a path to be cleaned; and cleaning the path using the brush member.

7. The method of claim 6, wherein the housing member further includes a scraping member configured to scrape debris.

8. The method of claim 6, wherein the brush member is formed from a twisted core material having bristles protruding therefrom.

9. The method of claim 6, wherein the absorbent material includes a hole configured to clean the brush member.

10. The method of claim 9, wherein the brush member is disposed within the hole when the handle portion is assembled onto the housing member.

* * * * *